US011760440B2

(12) United States Patent
Vodopianov

(10) Patent No.: US 11,760,440 B2
(45) Date of Patent: Sep. 19, 2023

(54) STABILIZED HULL OF A MONOHULL MOTOR BOAT, WHICH SURFS ON A WATER CUSHION AND HAS A DEEPLY SUBMERGED SUPPORTING BLADE

(71) Applicant: Ignat Mikhailovich Vodopianov, Zagreb (HR)

(72) Inventor: Ignat Mikhailovich Vodopianov, Zagreb (HR)

( * ) Notice: Subject to any disclaimer, the term of this patent is extended or adjusted under 35 U.S.C. 154(b) by 255 days.

(21) Appl. No.: 17/268,419

(22) PCT Filed: Dec. 6, 2018

(86) PCT No.: PCT/IB2018/059719

§ 371 (c)(1),
(2) Date: Feb. 12, 2021

(87) PCT Pub. No.: WO2020/035725

PCT Pub. Date: Feb. 20, 2020

(65) Prior Publication Data

US 2021/0339827 A1 Nov. 4, 2021

(30) Foreign Application Priority Data

Aug. 15, 2018 (RU) ..... RU2018129739

(51) Int. Cl.
*B63B 3/38* (2006.01)
*B63B 39/00* (2006.01)
(Continued)

(52) U.S. Cl.
CPC ..... *B63B 1/20* (2013.01); *B63B 3/38* (2013.01); *B63B 39/005* (2013.01); *B63B 39/06* (2013.01);
(Continued)

(58) Field of Classification Search
CPC ..... B63B 1/20; B63B 3/38; B63B 39/005; B63B 39/06; B63B 1/40; B63B 2001/201;
(Continued)

(56) References Cited

U.S. PATENT DOCUMENTS 2,144,111 A 1/1939 Higgins.
4,981,099 A 1/1991 Holder
(Continued)

FOREIGN PATENT DOCUMENTS

DE 202008004101 U1 7/2008
EP 2769909 A3 8/2014
(Continued)

*Primary Examiner* — Anthony D Wiest
(74) *Attorney, Agent, or Firm* — Thorpe North & Western LLP

(57) ABSTRACT

The invention is related to boatbuilding and may be used in construction and modernisation of high-speed monohull motor seagoing boats, where a single hull is used, which is moving in a surfing on a water cushion mode.
Stabilised hull of a monohull motor boat, which is using a surfing glide on a water cushion, with the deeply submerged displacement bearing blade, with a hull of a total width of not more than 50% of its length, which, in its lower part over its entire length, has a descending shape of its bottom surface in the direction bow-to-stern, where the bow is elevated up to the distance from the waterline, corresponding to at least 25% of the hull's width, and under the bow is a high wave-piercing stem. Wherein, in the front 40% of the hull's length, the bottom surface has a descending shape, which smoothly flows into the bottom surface of the stern part of the hull, and has an angle of descent in relation to the waterline at zero speed of at least 5 degrees, in the rear 60% of the hull's length, the bottom surface has a descending shape, and the angle of descent in relation to the waterline at zero speed of not more than 5 degrees, while it has an
(Continued)

almost flat shape in its cross section, and is submerged by 70% or more of its length below the waterline, where the submerged part becomes the "surfing surface", which is gliding, during the boat's movement, on a water cushion, and carrying not more than 70% of the boat's fully loaded weight.

The hull is made with a longitudinally positioned located underneath the bottom surface, symmetrical with respect to the boat's centerline, and commensurate with its length, vertically oriented, deeply submerged displacement bearing blade of narrow shape and of low wave/hydrodynamic resistance; wherein the ratio of the length to the width of the bearing blade of at least 20 times, with the displacement of the bearing blade corresponding to 30-50% of the boat's fully loaded weight, and with its height (excluding the stem) of not less than 20% of the maximum width of the hull, wherein ensuring a deep submersion of the bottom edge of the bearing blade in relation to the waterline. The bearing blade is made with wave-piercing lines, with a high wave-piercing stem, reaching by its height the bow end of the bottom surface of the hull, with the sharp rear and front lines, and the smooth middle lines; and has a triangular cross section over its entire length, with the most acute angle at its bottom; and the maximum width of the bearing blade is located within 40-60% of its length, which determines the centre of the displacement of the bearing blade within 40-60% of its length, in its upper third.

The controllable hull of the displacement boat stabilised for sea waves conditions and gliding on the water cushion, opens up broad prospects for the construction of the high-speed seagoing boats. First of all, this is a fundamental improvement in stability of the movement, and the absence of rolling/pitching and yawing in the open Sea, as well as increase in a carrying freight capacity and improvement in the fuel economy, as compared to the planing hulls.

1 independent item of formula. 1 dependent item of formula. 15 illustrations.

1 Claim, 5 Drawing Sheets

(51) Int. Cl.
*B63B 1/20* (2006.01)
*B63B 39/06* (2006.01)
*B63B 1/40* (2006.01)

(52) U.S. Cl.
CPC ..... *B63B 1/40* (2013.01); *B63B 2001/201* (2013.01); *B63B 2003/385* (2013.01); *B63B 2039/067* (2013.01); *B63B 2039/068* (2013.01)

(58) Field of Classification Search
CPC ..... B63B 2003/385; B63B 2039/067; B63B 2039/068; B63B 1/18; B63B 1/04; B63B 1/16; B63B 1/32; B63B 39/00; B63B 1/06; B63B 1/08
See application file for complete search history.

(56) References Cited

U.S. PATENT DOCUMENTS

| | | | | |
|---|---|---|---|---|
| 5,832,855 | A | 11/1998 | Gellekink | |
| 6,112,687 | A | 9/2000 | Eder | |
| 6,131,529 | A | 10/2000 | Smith | |
| 7,984,683 | B1 | 7/2011 | Hupy | |
| 11,077,918 | B2 * | 8/2021 | Vodopianov | B63B 1/04 |
| 2006/0288922 | A1 | 12/2006 | Seider | |

FOREIGN PATENT DOCUMENTS

| | | | | |
|---|---|---|---|---|
| FR | 2477500 | A1 * | 3/1980 | B63B 1/18 |
| GB | 2356603 | | 5/2001 | |
| RU | 2615031 | C2 | 3/2017 | |
| RU | 2624142 | | 6/2017 | |

* cited by examiner

Fig. 1.1. Perspective View Front.
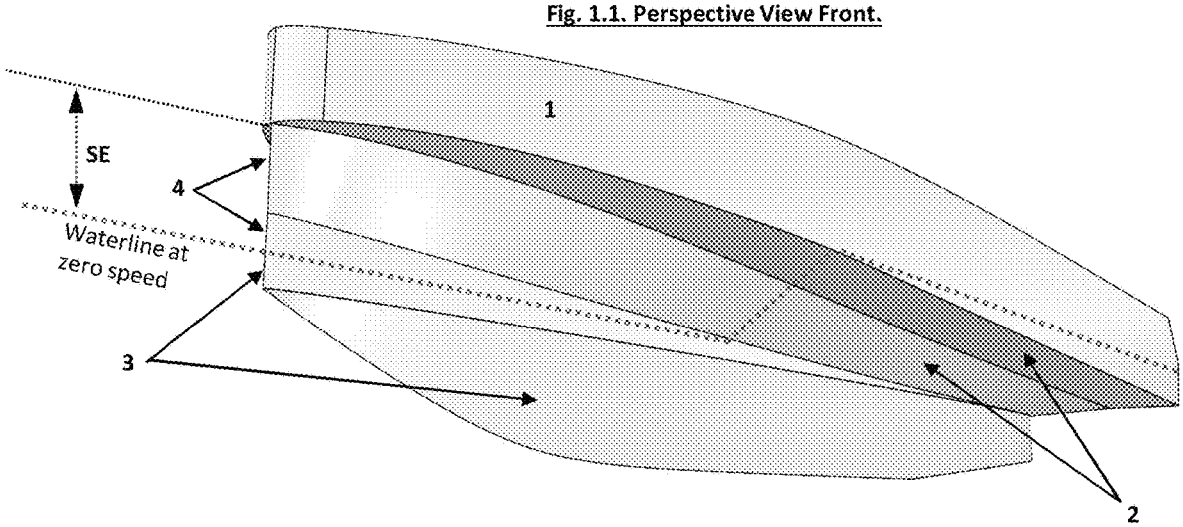
Fig. 1.2. Perspective View Stern.
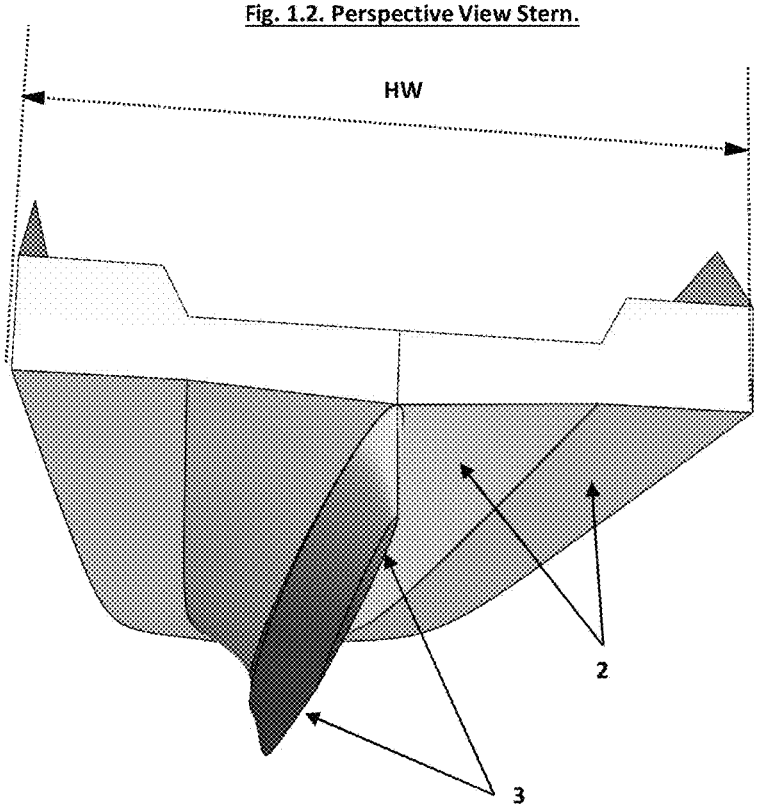

Fig. 1.3. Front View.
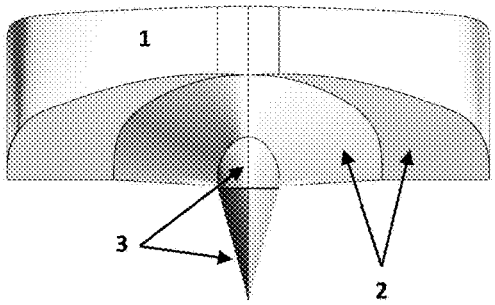
Fig. 1.4. Back View.
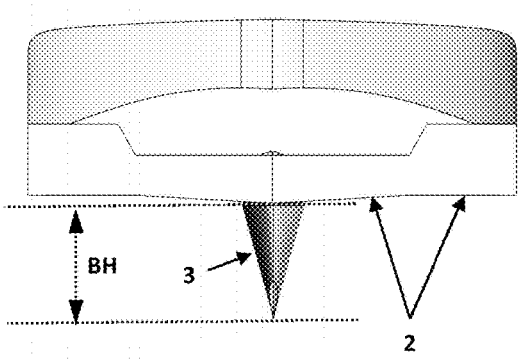
Fig. 1.5. Bearing blade.
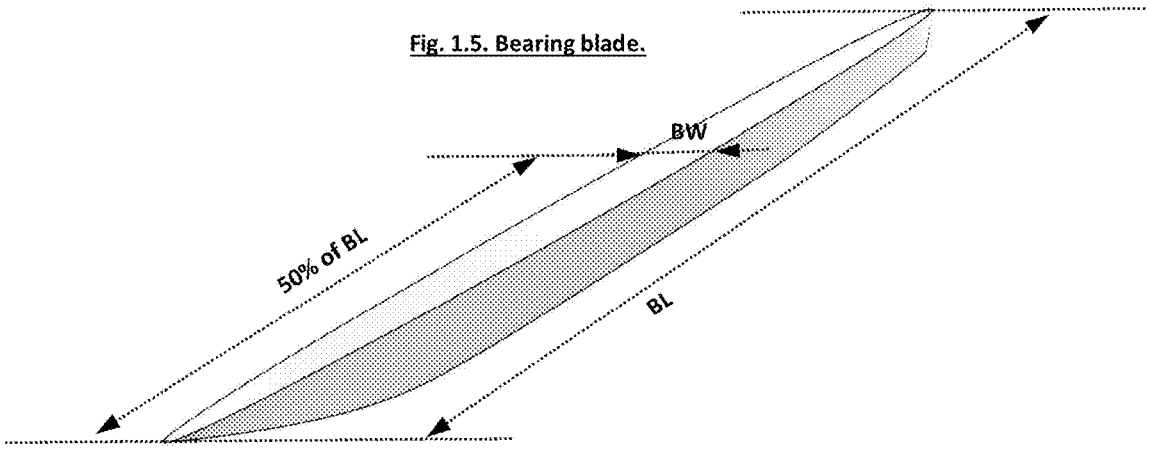
Fig. 1.6. Right View.
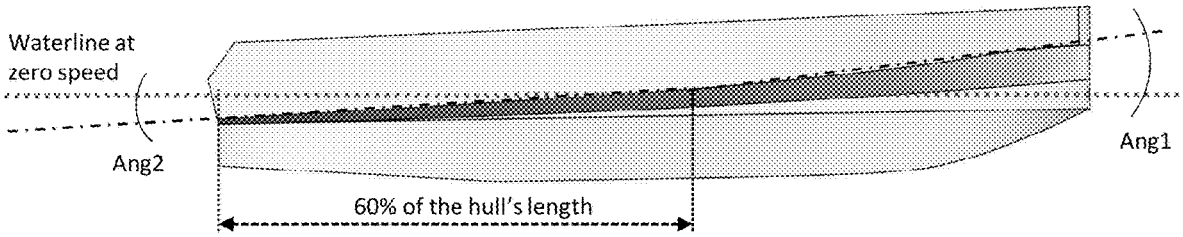
Fig. 1.7. Bottom View.
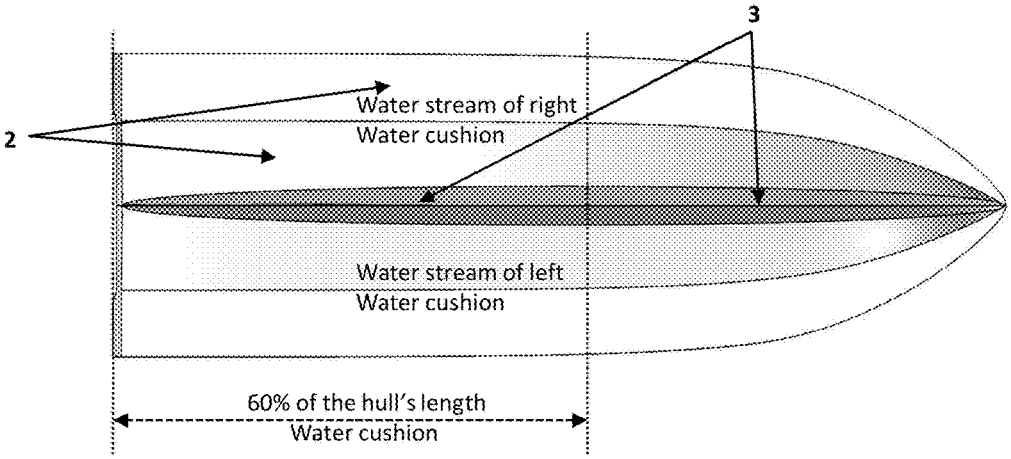

Fig. 2.1. Water cushion.
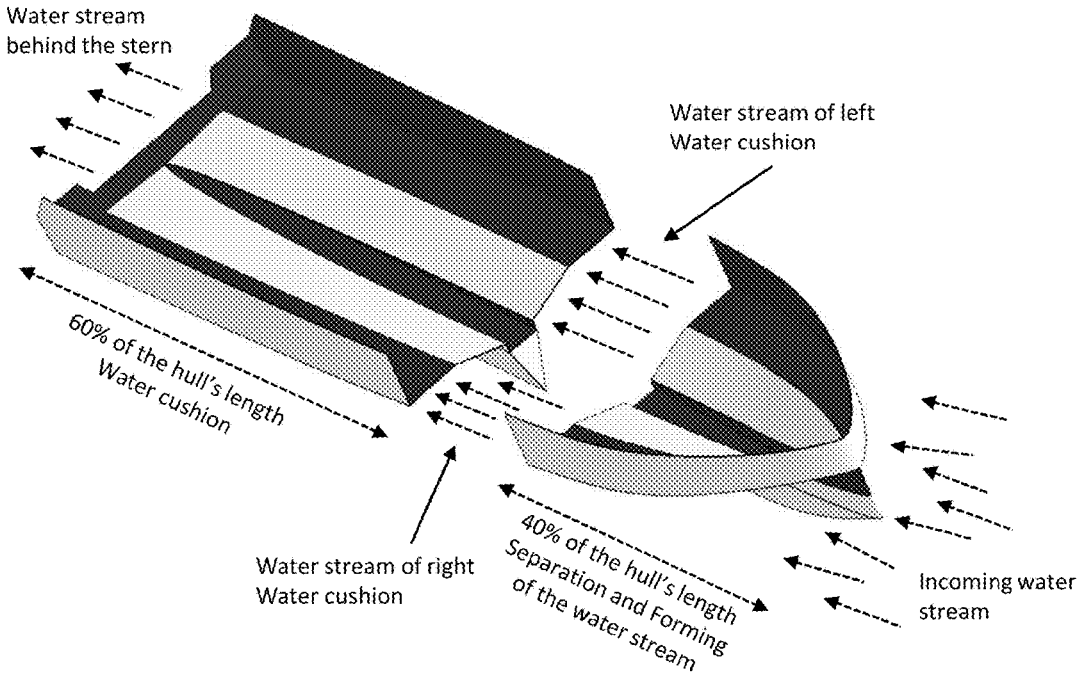
Fig. 2.2. Right View. Rotation.
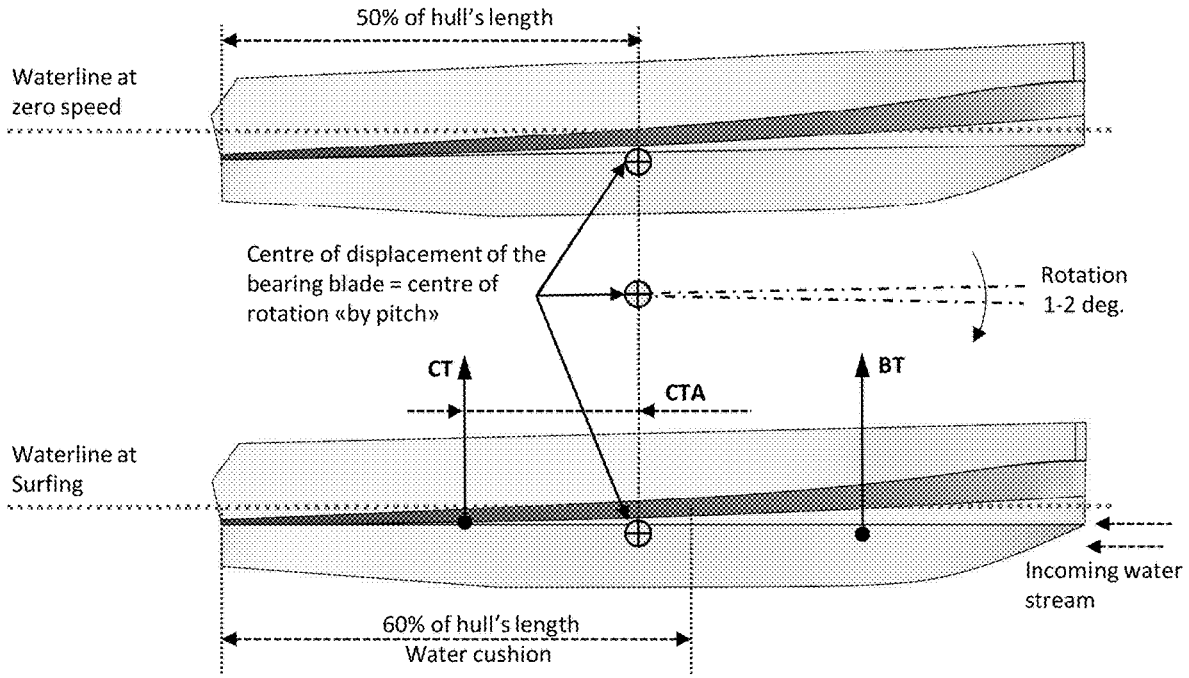

Fig. 3.1. Right view. Longitudinal balancing at zero speed.
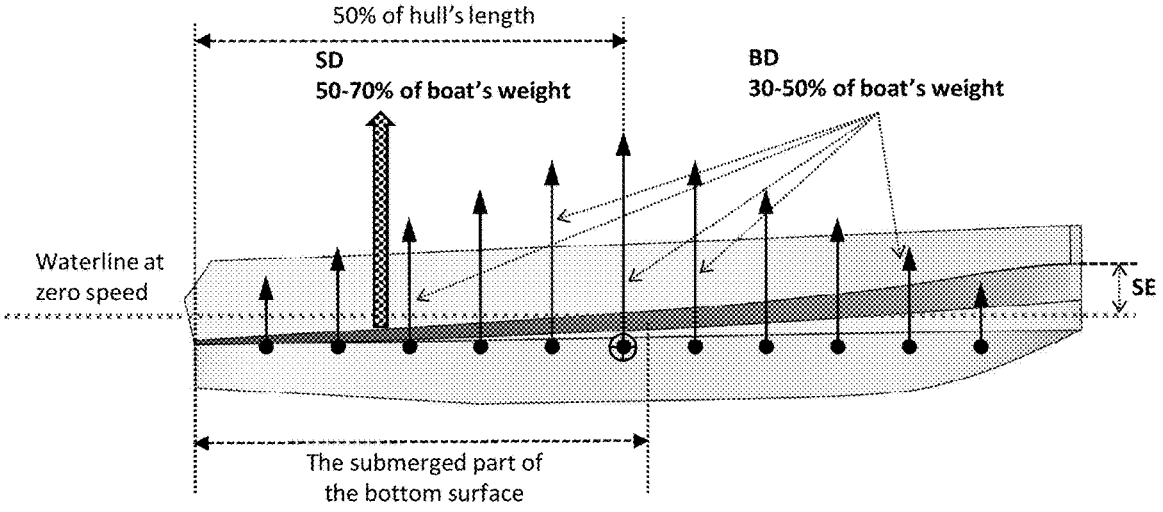
Fig. 3.2. Right view. Longitudinal balancing on the water cushion.
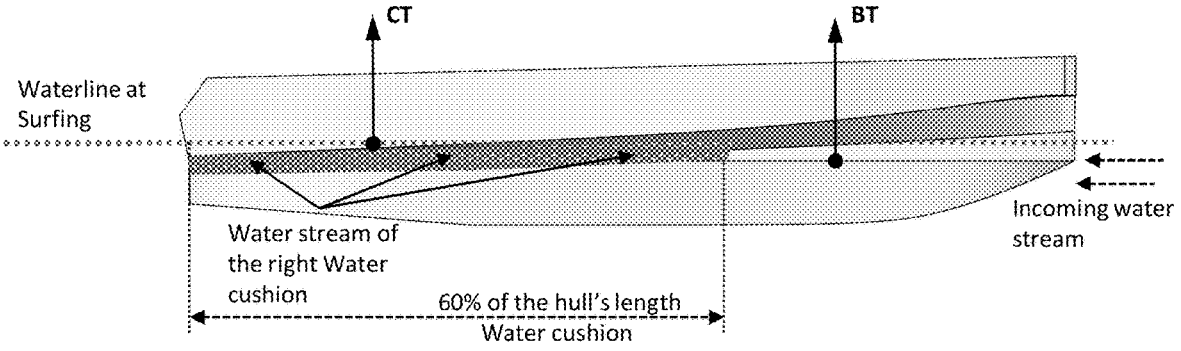

Fig. 3.3. Right view. Crossing a transverse wave.
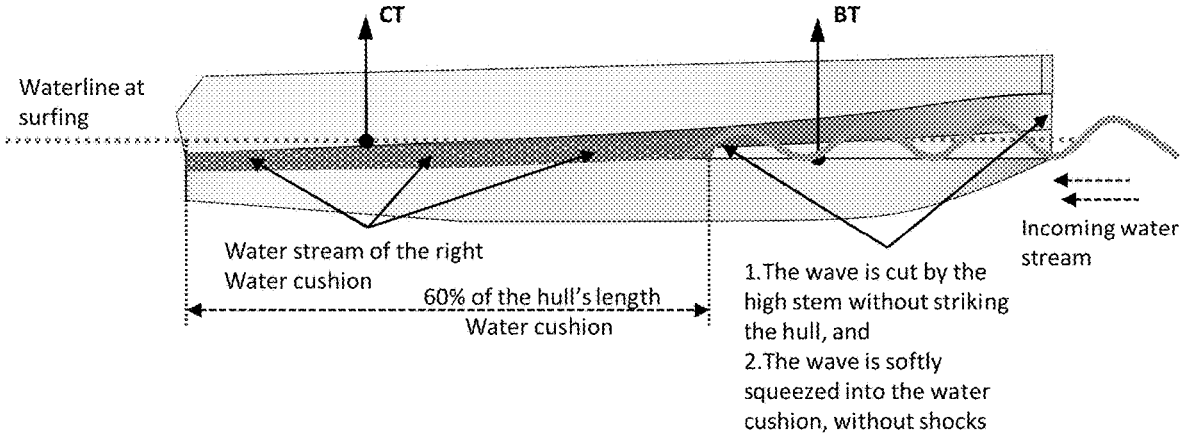
Fig. 3.4. Rear view. Movement without a wave.
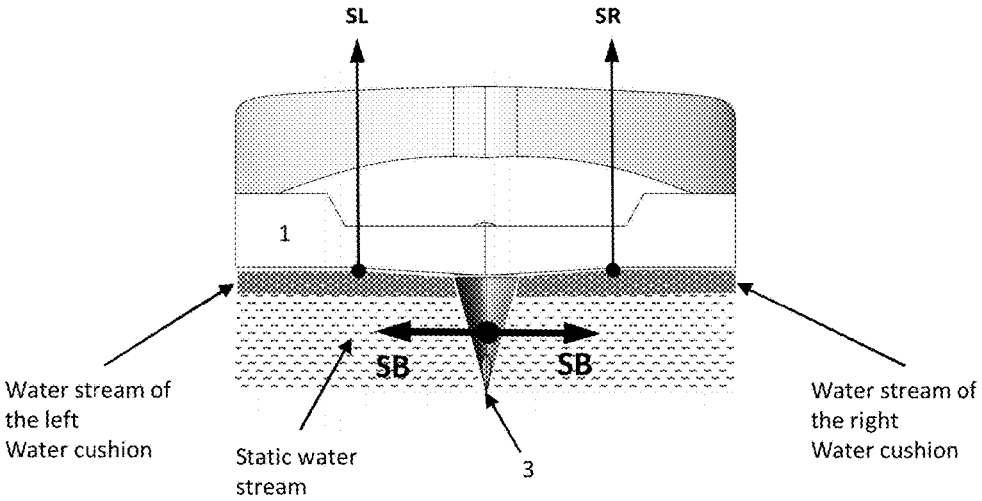
Fig. 3.5. Rear view. Movement when the wave is from the left.
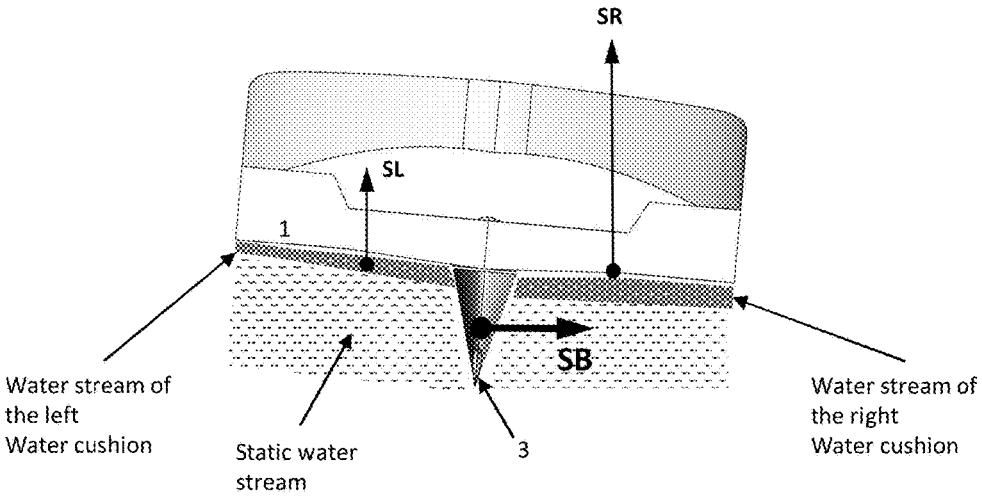

STABILIZED HULL OF A MONOHULL MOTOR BOAT, WHICH SURFS ON A WATER CUSHION AND HAS A DEEPLY SUBMERGED SUPPORTING BLADE

FIELD OF THE INVENTION

The invention is related to boatbuilding and may be used in construction and modernisation of high-speed monohull motor seagoing boats, where a single hull is used, which is moving in a surfing on a water cushion mode.

PRIOR ART

Planing and Surfing

The definition of "high-speed seagoing" boats, in this case, includes seagoing boats weighing 3 tons or more, capable of maintaining the cruising speed of 20 knots or more in the open Sea, i.e. in the presence of a wave. With the weight of 3 tons or more, the factors of the hull's shape and the choice of the way of achieving the high speed in the conditions of an open Sea become fundamental, and there is a big difference between the "planing" and the "surfing" modes. Some hulls of modern boats are capable to move in both modes—in their usual mode, and if there is a co-directional long flat wave, with the wave's length exceeding the boat's hull length, in a surfing mode.

Planing—is a mode of a boat movement when: a) the boat, by using its hull shape and thrust of its propulsion motors, creates the wave, of the length and the width being suitable for its planing, and b) by using the propulsive thrust, [the boat] pushes its hull over the top of that wave to its front edge, where c) the hull develops the high-speed by planing on its small planing "sole" located in the stern. Planing requires speed, the planing hull leaves behind a distinctive cut wave—a "gull's wing".

Modern seagoing high-speed planing hulls have the shape of the hull, which is a compromise in order to achieve a sustainable planing mode. Typical shape has sharp lines of the bow, V-shaped middle lines, and a more flat planing supporting "sole" of small length and width, at the stern of the hull. In the planing mode, the planing hulls do not have any other support on the water surface, besides the "sole"; at the same time, planing on a small "sole" has limitations to stability of the run on a large wave—the large rolling, the inevitable jumps followed by a hard landing at crossing the wave, slipping of the planing "sole" from the wave in an arbitrary direction in a condition of a side and cut wave; as a result of such slipping the bow of the boat gets buried into the water surface with great acceleration and the magnitude, and with a strong distinctive blow. Safe control of the planing hull under the high-wave conditions requires great skills.

It would be logical to assume an increase in the size of the planing "sole" for the increase of the stability of the run. However, with an increase in the length of the "sole", the length of the wave, which must be created and "pushed over" by the planing hull, also increases; and the speed required for entering into the planing mode increases accordingly. With an increase in the width of the "sole", the width of the wave to be "pushed over" also increases, the boat begins to "paddle by its stern"; wherein dramatically increases the energy consumption (and the propulsion power) required for reaching the planing mode and for maintaining it.

A distinct feature of the planing hulls is the need of using part of the propulsion thrust to create and maintain the wave, on which the hull is then planing; and to push the hull over that wave, which happens essentially non-stop in order to maintain the planing mode. Therein, a moderate increase in the size and weight of the hull requires many times increase in energy consumption.

Modern industry has come to a compromise "standard" for design of most planing boats: planing occurs at the speed of 15-16 knots with relatively low power consumption, which demands the manufacturing of relatively narrow hulls with a short "sole" and, accordingly, leads to a low stability on the sea wave. The maximum length of planing hulls has been accepted at 18-20 meters. Modern planing hulls are characterised by simplicity of design and excellent habitability of the residential compartments.

Surfing—this is a mode of boat movement, in which the hull by its shape is squeezing underneath itself the incoming flow of water and creates its excess under its large flat bottom surface; where the excessive dynamic water flow is self-distributed, and forms a stable form and a large area layer between a more static water medium (below) and the bottom surface of the hull (above); this layer is the "water cushion"; wherein the boat glides on the water cushion, and its weight is distributed over its entire area. The main feature of surfing, in comparison with the other high-speed hulls, is the absence of any influence upon the incoming water stream, except for its squeezing. The surfing hull does not leave waves behind its stern—for the casual observer, visually this is the main difference between the Surfer boat and the Planing boat of the same weight, running side by side, at the same speed.

Surfing is characterised by an extremely low resistance to movement—only from the force of friction of the hull's bottom surface on the water cushion, wherein the most important conditions are: ensuring laminarity and continuity of [water] flow in the water cushion, the absence of hull's elements "pushing" the water flow to the sides, and also ensuring the impossibility of the air masses breaking through under the bottom surface of the hull into the working water cushion.

In contrast to the air, the water is almost incompressible, therefore it would be incorrect to describe the effect of the water cushion by analogy with the air cushion. The air cushion is an area with an increased air pressure, whereas the water cushion is an area with an excess volume of the dynamic water flow. On the water cushion, there is no perceptible rise of the hull, since the water flow has a density exceeding one of the air by about 800 times; respectively, the working effect of the water cushion is achieved with an extremely small actual lift of the boat's hull—no more than a few centimetres; wherein a laminar continuous dynamic flow goes underneath the flat bottom surface, along the entire length of the boat and across its entire width, and dissipates beyond the stern. When switching to a surfing mode, the hull "swells" on the water flow, the resistance to movement drops sharply and the speed increases.

The flat bottom surface of the surfing hull provides for the simplicity of its construction and excellent habitability of the residential compartments. Energy consumption to achieve the surfing mode is small and does not increase proportionally with an increase in the size and weight of the boat; the key is sufficient water flow, being squeezed into the water cushion, and the weight of the boat being distributed over a flat bottom surface of the hull. Wherein, the water cushion is being constantly fed by the high-speed flow of incoming water, which leads to its independence from the surrounding wave disturbances. Unlike planing, surfing does not require creation of the hull's own wave, and does not require associated with this energy consumption.

In the technology level is known a surfing mode, where gravitational force plays the role of the propulsion unit, and the water cushion is presented by a long flat co-directional wave that is longer than the length of the boat's hull, and that exists independently of the boat's propulsion ("gravitational surfing"). In this case, the wave is a natural phenomenon and is not created by the boat itself. Consider a keel yacht with a displacement hull, moving in the mode of the gravitational surfing, wherein:

1. The yacht is gaining a significant speed comparable to planing hulls and significantly exceeding the maximum speed of its water displacement mode, wherein the hull does not enter the planing mode,
2. behind the yacht there is no noticeable wave created by the hull of the yacht,
3. the gliding speed is limited by the friction force of the bottom surface of the hull against the incoming water flow,
4. the yacht becomes independent of the surrounding sea waves—surfing on one wave stabilises the yacht against other wave disturbances, rolling and pitching, both stop,
5. potentially, the yacht can be arbitrarily heavy—if the hull has a flat bottom surface of sufficient area,
6. the size of the surfing surface can be arbitrarily large—in practice, the larger the better, i.e. there are no restrictions by the length and width of the planing sole typical for planing hulls,
7. the energy consumption is extremely low, the movement of the boat at high speed depends only on the constancy of the wave and on the skills of the Skipper in keeping the yacht on it.

That is, the surfing glide mode can be described as "movement of a heavy displacement hull at high speed, without planing mode, with low hydrodynamic resistance, without the stern wave formed by the hull, without rolling and pitching, regardless of the surrounding waves; with a hull of almost any size and weight, and with low power consumption", collectively hereafter—"the advantages of the surfing glide".

However, without additional elements of stabilisation, the boat's hull moving in the surfing mode, presents a highly unstable structure. The flat bottom surface of the hull is movable in any direction and has a tendency of slipping off the excessive dynamic water flow, which is underneath it. In the example of a keel yacht being in a gravitational surfing mode (see above), maintaining the stability of the movement requires great skills from the Skipper.

In patent RU2615031, the author claims "known high-speed boats: airfoil boats, planing hulls, hydrofoil boats, with air caverns and cushions—all of them have propulsion units that create a thrust—force to move the boat, and the hull of the boat that creates the main force of resistance to movement, except for the surfing board, which is driven by a traveling wave of surf". In the patent RU2615031, the principle of the water cushion is described. In case of forced infusion of water flow under the stern of the hull of the boat, a water cushion is created, characterised by a convex water surface, providing for a surfing glide of the stern of the boat over a synchronously running wave of the "water cushion". To achieve this result, thrust propulsion units are placed on the bow of the boat, and their vectors are directed under the stern part of the boat. The disadvantages of this design include the need to move the propulsion units on the bow, beyond the hull; as well as a surfing glide of the stern of the boat in an arbitrary direction under actions of the sea wave. Thus, the hull claimed in patent RU2615031 cannot be a seagoing high-speed boat.

Other High-Speed Seagoing Hull Structures

Narrow displacement wave-piercing hulls of low hydrodynamic resistance and low rolling stability are applicable mainly on the multi-hull catamarans and trimarans, which have a large distance between the hulls for their stabilisation. Besides the large and inconvenient operational dimensions, with their width comparable to the length, catamarans and trimarans, at a certain length of the sea wave, cannot be stabilised by changing course with respect to the wave, which entails limitations in their seaworthiness; such structures also have narrow habitable compartments. Such hulls do not run in a surfing glide mode.

SWATH—hulls with a narrow waterline where the centre of the displacement is located deeply below the water surface. Such designs require automatic control systems and are difficult in operation. Such hulls do not run in a surfing glide mode.

Hydrofoil boats—their use is limited by the wave height, when, at high speed, part of the wing flies out of one wave and crashes into another, which is accompanied by strong blows and rapid wear of hydrofoils and their anchorages. Such hulls do not run in a surfing glide mode.

Catamarans and trimarans planing on the bottom of their floats are also known as the Sea Sledges. They have increased seaworthiness as compared to monohull planing hulls, since the planing "sole" is distributed over a greater part of the hull length. Increase of seaworthiness, however, is limited to the courses perpendicular to the wave, while on courses parallel to the wave, the Sea Sledges behave the same way as an ordinary single hull planing hull. In addition, when the length of the Sea Sledges is more than 7-8 meters, their construction requires very specific deeply submerged propulsion units, since with the narrow planing surfaces, and with the stream of the air flow in the tunnel cavities located above the water surface and underneath the bottom [of the hull], the incoming water flow becomes highly saturated with air, and the conventional propulsion unit loses its thrust. For these reasons, the Sea Sledges have received little distribution. An example of such hull is given in the patent US 2006/0288922 A1, where the elements of the "Sea Sledge-Trimaran" hull raise the hull above the wave disturbances on the water surface. Also an example from the patent RU 2 624 142, where the planing hull has trimaran lines. Such hulls do not run in a surfing glide mode.

U.S. Pat. No. 6,131,529 claims the combination of a high-speed central wave piercing hull with stabilising planing ski elements. In essence, this is the construction of the Sea Sledge—Trimaran with a central non-planing wave piercing hull. This design has a small width (that is, it does not require the dimensions of the ordinary trimarans to stabilise itself), whereas a deeply submerged central narrow hull provides stability on a wave better than planing hulls and Sea Sledges, since the hull doesn't slip off the wave to the side and it does not "jump" on the waves. The disadvantages include the need in spending energy of the propulsion unit to lift the hull on the "planing skis", as well as the need for deeply submerged specific propulsion unit—like on traditional Sea Sledges. In practice, such a design was tested; a practical improvement in the stability on the across the wave courses was shown. On the courses along the wave, the rolling was demonstrated, like on a typical planing hull, and on any courses a water [/air] mixture was observed in the propellers with the loss of the propeller's thrust on the wave. Critical here is the presence of airflow breaking through the cavities between the central blade and the planing skis. Such hulls do not run in a surfing glide mode.

There is known design solution of "air cushion", where an increased pressure of air mass is created underneath of the hull of the boat, while the hull of the boat is raised above the water surface, thus, the hydrodynamic resistance to the motion disappears, leaving only the aerodynamic one. Two types of the design of the air cushion can be made:

Closed type—when airflow is forced into a closed volume underneath the bottom of the hull and thus pressure under the hull of the boat increases, creating the air cushion that leads to the hull rising above the water surface; and Open type—also known as "airfoil boats", where, in the process of movement along the water surface at extremely low altitude, a large winged airfoil boat with the appropriate angle of attack creates underneath a high pressure area- an "airfoil", which provides a support for keeping the airfoil boat in flight above water.

The disadvantages of the air cushion of a closed type include a low seaworthiness of the boat, when, at a high wave, the air begins to escape from the air cushion to the sides, thereby losing the required working pressure inside of the air cushion; and the hull is lowered into the water. Such hulls do not run in a surfing glide mode.

The disadvantages of airfoil boats can be attributed to their low carrying capacity as compared to other boats, because for a complete separation from the water surface and movement in the "airfoil" mode, the weight of the boat must be low; and also their low seaworthiness—namely, the influence of atmospheric disturbances from waves and wind on a structure flying low overwater. Such hulls do not run in a surfing glide mode.

In the application EP 2007/056614 20070630 a narrow hull is indicated with a draught increasing towards the bow, with a minimum expansion of the bow sections, with a high and a deeply immersed sharp stem located in the front part. The stem is located only in the bow, but not in the stern of the hull; it is used to optimise cutting of transverse wave. This boat doesn't run in a surfing glide mode, the stem is not acting as a bearing blade, ensuring the seaworthiness of the surfing hull, and it is located only in the bow of the boat; it is not used to create a laminar continuous water flow in the left and right water cushions; the boat doesn't have a flat surfing surface.

U.S. Pat. No. 4,981,099 indicates the hull with a deeply immersed torpedo shaped displacement hull. This is one of the versions of the SWATH hull with a low waterline. The hull doesn't have a flat surface and doesn't run in a surfing glide mode; the displacement of the submerged torpedo hull is not used for reducing the distributed weight of the boat on the surfing surface and for stabilising the hull.

Patent EP 2 769 909 A3, indicated the hull having an oblong displacement element of a rounded cross section under the waterline, a high stem, rounded sides lowering to the stern, lowering hull lower surface, tunnel rounded lines of the lower surface of the hull. Then the sides and bottom surface rise at the stern significantly above the waterline. Such hull doesn't have a flat surfing surface and cannot run in a surfing glide mode; the rounded shape of the side bars and the bottom surface, and also their rise at the stern above the waterline, the tunnel cavities at the level of the waterline, where an outbreak of air is inevitable when the speed increases, predetermine the impossibility of the surfing glide mode; the rounded shape of the submerged element will lead to a keel rolling at high speed.

There is known formula of the useful model 2014116954/11, where the planing hull is equipped with a hydrodynamic ski, with a size approaching the size of the hull. With such a size of a planing ski, this is actually not a planing hull, but a surfing one. The claimed hull doesn't have the bearing blade, as well as any other stabilising elements to ensure seaworthiness in the conditions of the sea waves; and for this reason it cannot be used on a heavy high-speed seagoing boat.

Due to the combination of their advantages and disadvantages, the most widely used are planing hulls of high-speed seagoing boats. In the present application, these types of hulls are assumed to be the "modern technology level".

DISCLOSURE OF THE INVENTION

According to the applicant, the stabilised hull of the high-speed seagoing boat using surfing on a water cushion is not known from the technology level.

The applicant had built and tested in August 2018, in the conditions of the open Sea, the monohull motor boat with the claimed hull that is using surfing on the water cushion, with a deeply submerged bearing blade. Hull length is 12.5 m, width is 3.9 m, weight is 5,800 kg, 2 outboard engines are of 150 hp each. The conclusions on the technical results achieved by this invention, as well as its comparison with the planing hulls, were obtained directly from practical tests of the claimed solution in the open Sea, and from the comparison of a monohull motor boat with the claimed hull, against planing hulls of similar size and weight.

The stabilised hull of a monohull motor boat has a deeply submerged blade 12.5 m long, 50 cm wide and with height (excluding the stem) of 90 cm. The bearing blade has a maximum width at 50% of its length and the triangular cross-sectional shape. The ratio of the length to the width of the bearing blade is 25 times, its height (excluding the stem) is 23% of the maximum width of the hull. The angle of descent of the bottom surface within 40% of the bow length of the hull is 7 degrees, and in 60% of the stern length of the hull is 4 degrees.

The stabilised hull of a monohull motor boat confidently enters the surfing glide mode at a speed of 14-15 knots, develops a maximum speed of 24 knots and has fundamentally better seaworthy characteristics and fuel economy in sea waves conditions, as compared to the planing hulls.

Claimed solution, which is unknown, according to the applicant, from the technology level, allows to use the hull, surfing on a water cushion, with a deeply submerged bearing blade, in the design of high-speed monohull motor seagoing boats, which allows to use the known advantages of surfing glide mode, namely the "movement of a heavy displacement hull at high speed, without planing mode, with low hydrodynamic resistance, without forming a stern wave by the hull; without rolling and pitching, regardless of the surrounding waves; with a hull of almost any size and weight, and with low power consumption", wherein, the use of a deeply submerged bearing blade makes it possible to stabilise the surfing hull under the conditions of the sea waves, which is a fundamental condition for the practical application of the surfing hulls in seagoing boatbuilding. The claimed shape of the bearing blade is very specific for achieving the result of seaworthy surfing of the heavy hull, wherein the most important factors are:

A. Extremely narrow, sharp streamlined shape of the bearing blade, with a length/width ratio of at least 20 times, wherein the incoming [water] flow retains its laminarity and continuity along the entire path of its flow around the bearing blade, which allows successful filling up of the water cushions, and also ensures the operation of the stern propulsion units in a normal mode;

the bearing blade has a minimal impact on the speed of the boat with its low hydrodynamic resistance;

the front edge of the bearing blade is a narrow wave-piercing stem, wherein the wave is cut by the bearing blade, and its energy is dissipated in the process of filling up the water cushions, without striking the boat's hull;

B. The bearing blade is of triangular shape in a cross section, its displacement centre is in its upper third, and in its longitudinal middle, wherein in the centre of the displacement of the bearing blade is located the centre of rotation of the hull "by pitch" during the acceleration and attaining the high-speed surfing mode, with the required thrust arm of the torque of the water cushion's thrust in relation to the centre of rotation;

the centre of the displacement of the hull is located high, approximately at the level of the bottom surface of the hull, allowing for self-stabilisation of the hull during rolling and pitching;

C. Large submerging of the bottom edge of the bearing blade in relation to the waterline, at least 20% of the hull's width, wherein providing the impossibility of transverse slipping of the hull from the water cushion, and the impossibility of rolling and yawing of the hull when in motion;

the separation of the [water] flow of the right and the left water cushions is ensured, which is fundamental in ensuring the transverse stability of the hull, where the transverse stability is provided by the thrust of the deeply submerged blade and of the lee-wave surfing surface, on the dynamic water flow;

D. The displacement of the bearing blade in the range of 30-50% of the weight of a fully loaded boat, wherein the weight of the boat applying to the surfing surface is not more than 70% of the boat's weight, which facilitates attaining the surfing mode, and also ensures maintaining of a stable surfing mode;

by the thrust of its displacement, the bearing blade provides a longitudinal balancing and the required position of the hull in relation to the waterline, forming of a high wave-piercing stem over the waterline that ensures the passage through the wave, the possibility of placing the bow end of the bottom surface above the level of wave disturbances;

by thrust of its displacement, it provides the necessary angle of descent of the bottom surface, that is required for squeezing the [water] stream into the water cushion; and the working angle of attack of the surfing surface, as well as the necessary submerging of the surfing surface when gliding on a water cushion, which ensures steady surfing without breaking of the air through under the bottom surface of the hull;

by thrust of its displacement in the front part, which is balancing the thrust of the water cushion, it provides a longitudinal stabilisation of the hull when gliding on the water cushion, by creating two widely separated points of the longitudinal support of the surfing hull, thus ensuring the absence of pitching.

That allows to achieve a technical result, which consists of:

a stable controlled movement of the high-speed monohull seagoing boat in the surfing glide mode on the water cushion, at a speed of 20 knots and more, under the conditions of sea waves;

an extremely low resistance to movement, only due to the friction of the surfing surface; wherein, unlike in planing hulls, the energy of the propulsion is spent only on the forward movement;

large freight capacity of the boat, provided the weight is distributed per unit area of the flat bottom surface;

independence of the water cushion from variations of the incident waves, because the water cushion is dynamically fed by the incoming water flow, which is stable, and its speed is much higher than one of any surrounding wave disturbances;

ensuring a stable run through the transverse wave, which is freely cut by the bearing blade, and then pressed by the bottom surface of the hull into the left and right water cushions;

ensuring a stable run through the longitudinal wave due to the side thrust of the deeply submerged blade and the thrust of the side part of the hull against the water cushion;

increase in the speed by 30-50% or saving 30-50% of fuel, as compared to planing hulls, because propulsion energy is not required to create/pushing over of the planing wave;

simplicity of design and operation, with using conventional propulsion units, including outboard motors.

As a result, the claimed hull of a monohull motor boat, that is using surfing on a water cushion, with a deeply submerged bearing blade, applied to a high-speed monohull seagoing boat, ensures, as compared with the current level of technologyplaning monohull boats), provided that the hull is with a width of not more than 50% of its length:

new hydrodynamic characteristics consisting of the benefits of surfing glide "movement of a heavy displacement hull at high speed, without planing mode, with low hydrodynamic resistance, without the stern wave formed by the hull, without rolling and pitching, regardless of the surrounding waves, with a hull of almost any size and weight, and with low power consumption", fundamental improvement in the stability of the hull's movement, and stable passage of transverse and longitudinal sea waves without rolling, without pitching, and without yawing;

more efficient system of counteracting rolling and pitching on all courses relative to the wave;

new property "dynamic stabilisation of the movement on the wave"—the higher is the speed, the more filled up is the water cushion, and the more stable the boat is;

absence of stern wave and low resistance to movement, which leads to savings of 30-50% of fuel with the same dimensions and speeds of the boat;

similar simplicity of design and operation;

similar volume of habitable compartments and excellent handling.

Wherein a stabilised hull of a monohull motor boat, which is using surfing glide on a water cushion, with a deeply submerged displacement bearing blade, characterised by the total width of the hull of not more than 50% of its length, which in its lower part:

has over its entire length, a descending shape of its bottom surface in the direction bow-to-stern, wherein, the bow end of the bottom surface is elevated to the distance from the waterline, corresponding to at least 25% of the width of the hull; where there is a high wave-piercing stem located under the bow end of the bottom surface, wherein, in the front 40% of the length of the hull, the bottom surface has a descending shape, smoothly flowing into the bottom surface of the stern part of the hull, and has the angle of descent of at least 5 degrees, in relation to the waterline at zero speed, wherein, in the rear 60% of the length of the hull, the bottom surface has a descending shape, and has the angle of descent in relation to the waterline at zero speed, of not more than 5 degrees, wherein it has nearly flat shape in its cross section and is submerged by 70% or more of its length below the waterline as counting from the stern, where the submerged part becomes the "surfing surface", which is gliding during the boat's run, on the water cushion, and carrying no more than 70% of the boat's fully loaded weight, wherein, the hull is made with a longitudinally positioned located underneath its bottom surface, symmetrical in relation to the boats' centerline and commensurate with its length, vertically oriented deeply submerged displacement bearing blade of narrow shape and of low wave/hydrodynamic resistance, wherein, the ratio of the length to the width of the bearing blade is at least 20 times, with the displacement of the bearing blade corresponding to 30-50% of the boat's fully loaded weight, and with the height (excluding the stem) of not less than 20% of the maximum width of the hull, wherein ensuring a deep submersion of the bottom edge of the bearing blade in relation to the waterline, wherein, the bearing blade is made with the wave-piercing lines, a high wave-piercing stem, which by its height is reaching the bow end of the bottom surface of the hull, with the sharp rear and front lines, and smooth lines in the middle, wherein, the bearing blade, over its entire length, has a triangular shape in its cross section, with the most acute angle at its bottom; and the maximum width of the bearing blade is located within 40-60% of its length, which determines the centre of the displacement of the bearing blade within 40-60% of its length, in its upper third.

it is possible that the hull, on at least 30% of its length or more, as counting from the stern, at the maximum width of the hull, may include vertically oriented and symmetrical to the boat's centerline, thin longitudinal plates limiting the water flow, with their submersion below the waterline to the distance corresponding to at least 2.5% of the hull's width.

BRIEF DESCRIPTION OF THE DRAWINGS

Claimed materials are provided in the following graphic illustrations. A general view of the hull is shown on FIG. 1, various spatial views of the hull are shown on FIGS. 1.1-1.7.

FIG. 1. A general view shows the hull 1, including the bottom surface 2, and the deeply submerged bearing blade 3. The lower surface 2 has a descending shape in the direction of the bow-to-stern, along the entire length of the hull. As a result of support from the displacement bearing blade 3, the bow end of the bottom surface 2 is raised above the waterline of the boat, to the level of elevation of "SE", constituting not less than 25% of the maximum width of the hull "HW". Under the bottom surface raised in the bow there is a high narrow stem 4 extending into the upper part of the bearing blade 3. The bottom surface 2 in the stern part of the hull is almost flat.

The bearing blade 3 has its height "BH" (not including the stem), "BH" is not less than 20% of the hull's width "HW", while the ratio of the length of the blade "BL" to the maximum blade width "BW" is not less than 20 times. The maximum width of the blade is in the middle of the length of the bearing blade (variants of 40-60% of the length are possible). The bearing blade has a triangular shape in the cross section along its entire length, with the most acute angle being at the bottom. Thus, the blade displacement centre is in the middle of its length, in the upper third. The bearing blade displaces an equivalent weight of 30-50% of the boat's fully loaded weight, that is, the bottom surface of the hull carries 50-70% of the boat's weight. Reducing the weight of the boat per unit area of the surfing surface contributes to creating and maintaining the laminar continuous [water] flow inside the water cushions.

In the front 40% of the hull's length, the descent of the bottom surface forms an angle in relation to the waterline at zero speed "Ang1" not less than 5 degrees, thus forming the squeezing surface impacting the water flow; and in the rear 60% of the length of the hull "Ang2" of no more than 5 degrees, wherein in the rear 60% of the length of the hull, the bottom surface has an almost flat shape in its cross section, thus forming the hull's surfing surface.

In its motion, the bearing blade 3 separates the incoming water flow into the flow to the left water cushion and into the flow to the right water cushion, both being directed underneath the bottom surface of the boat's hull.

FIG. 2.1-2.2. explain the creation of a water cushion. The water flow incoming on the hull of the boat is divided by the bearing blade, is squeezed by the front part of the bottom surface, and rushes under the surfing surface into the left and the right water cushions. At the same time, the continued compression of the water flow is forcing the redistribution of its excess underneath the entire area of the water cushions, while the bearing blade prevents the [water] flow between water cushions.

At a sufficient speed of the incoming water flow, the compression of the [water] flow under the surfing surface leads to the formation of two laminar continuous streams—in the left and in the right water cushions, respectively, flowing underneath the surfing surface; with the further increase in speed, these [water] flows, without losing their laminarity and continuity, are breaking away from underneath of the stern and dissipate. Wherein the surfing surface "swells" on the water cushion, which leads to a sharp drop in the hydrodynamic resistance to the hull's movement, the boat accelerates quickly; the engines go into a low-loaded, high-rpm mode of operation; and the stern wave disappears.

The centre of the displacement of the bearing blade is located in its upper third, in the middle of the length of the hull. When the surfing surface "swells" on the water cushion, the centre of the displacement of the bearing blade becomes the rotation point of the hull by pitch, by 1-2 degrees. Wherein, the thrust arm "CTA" of the water cushion's thrust "CT" in relation to the centre of rotation constitutes approximately 25% of the length of the hull, wherein "swell" on the water cushion and rotation of the hull occur at moderate speeds of 14-15 knots, in a mild controlled mode, and further gliding on the water cushion is balanced in the longitudinal direction. At gliding on the water cushion, the bearing blade prevents slipping in the transverse direction, and the hull heads forward at high speed, wherein the thrust of the displacement of the front half of the bearing blade "BT" prevents an increase in the angle of rotation, and provides a stable angle of attack of the surfing surface. The hull is in a state of a stable, sustainable seaworthy surfing.

FIG. 3.1-3.5. illustrate the stabilisation of the hull. In the state with no motion (FIG. 3.1.), the longitudinal balancing is provided by the displacement force "BD" of the bearing blade (shown as distributed) and the displacement force of the submerged surfing surface "SD" (shown in the centre of its displacement). This ensures the required distance of elevation of the bottom surface "SE", the required angles of descent of the bottom surface in the bow and stern parts in relation to the waterline, the required submerging of the surfing surface. The results of the sea trials of the claimed hull had demonstrated that the longitudinal balancing by the bearing blade is one of the most important conditions for the successful achievement of the seaworthy surfing mode.

In the mode of gliding on a water cushion (FIG. 3.2.), the longitudinal stability is provided by the combination of the thrust of the water cushion "CT" and the thrust of the front part of the blade "BT", where the distance between them is approximately 50% of the length of the hull, a large stabilising moment is formed, that is, the claimed hull, unlike a planing hull, has two longitudinal widely separated support points, wherein the surfing surface is also incomparably larger in its size than the planing "sole" of the planing hull. With increasing speed, the effect of the longitudinal stabilisation increases, wherein at high speed the filling up of the water cushions increases, and the incoming waves have a lesser effect on the bearing blade.

In crossing a transverse wave (FIG. 3.3.), the wave is cut by the wave-piercing stem and passes along the hull of the boat, where the wave is squeezed by the bottom surface into the left and the right water cushions; thus, the impact of the wave on the front edge of the hull is absent; the wave creates an additional excess [water] flow in the water cushions, which does not affect the stability of the movement and the rolling/pitching of the hull.

In case of running without a wave (FIG. 3.4.), the water cushions are completely filled, the hull is constantly supported from below by the dynamic water flows "SR" and "SL", and it cannot roll to the left or to the right without "squeezing" the water cushion, which is practically impossible. The bearing blade, with its two-sided thrust, "SB" being deep under water, prevents the roll of the hull.

At high speeds of a surfing glide, when the wave hits on the left (FIG. 3.5.), the left side of the hull rises, the flow of the left water cushion becomes thinner, and its excess in the left water cushion decreases and provides a smaller thrust "SL" to the left surfing surface; at the same time, the flow of the right water cushion, on the contrary, thickens and makes a greater thrust to the right half of the surfing surface "SR"; wherein the water flow being divided by the bearing blade cannot be moving from the right water cushion to the left one; thus the excess of water flow and of thrust in the right water cushion right up the hull; the bearing blade prevents the hull from slipping to the right, whereas such slipping is inevitable for the planing hulls in a similar situation. During practical tests, the claimed hull demonstrated that side waves cannot force a roll on a surfing stabilised hull with the bearing blade. When trying to create a roll, the wave on the left side encounters resistance including the sum of the hydrodynamic thrust of the entire right surfing surface on the water cushion, and hydrodynamic thrust of the entire deeply submerged bearing blade against the dynamic [water] flow; wherein the total mass of the dynamic water flow, which pushes against the right surfing surface and against the bearing blade, is huge as compared to the mass of the wave coming from the left side; in this case the hull does not roll.

The controllable hull of the displacement boat stabilised in the sea waves conditions and gliding on the water cushion opens up the broad prospects for construction of the high-speed seagoing boats. First of all, this is a fundamental improvement in a stability of the movement, and the absence of rolling/pitching and yawing in the open Sea, an increase in carrying freight capacity and fuel economy as compared with the planing hulls, at cruising speeds of 20 knots or more, since the energy of the propulsion units of the surfing hull is not wasted on a creation of the planing wave and on "pushing over" it. The speed of movement of the surfing hull is limited only by the friction of its bottom surface against the dynamic flow of the water cushion, and this friction can be further reduced by using, for example, the new generation of gliding coatings. Surfing hull possesses simplicity of structural elements.

The claimed stabilised hull can be made, for example, out of fiberglass, other composite materials, wood, metal, polyethylene, and their combinations, and/or other materials acceptable in boatbuilding.

The invention claimed is:

1. A stabilized hull of a monohull motor boat, capable of surf gliding on a water cushion, the stabilized hull comprising:

a bow and a stern respectively defining a bow end and a stern end;

a length between said bow end and said stern end;

a port side and a starboard side;

said hull having a maximum width between said port side and said starboard side;

the maximum width of the hull being not more than 50% of the length;

an entire length of the hull having a bottom surface with a descending shape in a direction from the bow to the stern;

wherein the hull has a front portion extending 40% of the length of the hull from the bow end, the bottom surface of the front portion having an angle of descent of at least 5 degrees, in relation to a water line at zero speed;

the hull has a rear portion connected to the front portion, the rear portion extending 60% of the length of the hull to the stern, the bottom surface of the rear portion has an angle of descent of not more than 5 degrees, in relation to the water line at zero speed;

a cross section of said bottom surface of said rear portion has a nearly flat shape;

said bottom surface of said rear portion having a submerged part and a non-submerged part, said submerged part extending 70% or more of said bottom surface of said rear portion's length, where the submerged part becomes a surfing surface which glides on a water cushion during the boat's operation;

said submerged part carries no more than 70% of said boat's loaded weight;

wherein said bow end of said bottom surface is elevated above the water line by the distance corresponding to at least 25% of said maximum width of the hull, the bow end including a wave piercing stem located under the bow end of said bottom surface;

wherein the hull has a vertically oriented displacement bearing blade extending along a centerline of the hull from the bow to the stern;

wherein a ratio of a length to a width of the bearing blade is at least 20 times, and a height of the bearing blade excluding the said stem is not less than 20% of the maximum width of the hull;

the bearing blade having a displacement between 30% to 50% of said boat's fully loaded weight;

wherein the bearing blade over said bearing blade's entire length, has a triangular shaped cross section with a most acute angle at a bottom of the bearing blade;

a maximum width of the bearing blade and a center of displacement of the bearing blade is located within 40% to 60% of a length of the bearing blade, and a center of displacement is in an upper third of the cross section of the bearing blade; and the bearing blade is made with wave-piercing lines and a high wave-piercing stem, the stem having a height which reaches the bow end of the bottom surface of the hull, with sharp rear and front lines, and smooth lines in a middle of the bearing blade.

* * * * *